US005765478A

United States Patent [19]

Massey

[11] Patent Number: 5,765,478

[45] Date of Patent: Jun. 16, 1998

[54] METHOD AND DEVICE FOR PAINTING WITHOUT THE USE OF HANDS OR ARMS

[76] Inventor: Eddie S. Massey, 2118 Wilshire Blvd. #527, Santa Monica, Calif. 90403

[21] Appl. No.: 825,393

[22] Filed: Mar. 28, 1997

[51] Int. Cl.[6] ..... B41M 1/12

[52] U.S. Cl. ..... 101/129; 101/128.1; 401/6; 36/97; 36/113; 15/104.94

[58] Field of Search ..... 101/127, 128.1, 101/129, 333; 401/6; 15/256.5, 104.93, 104.94, 105, 245; 36/12, 15, 23, 97, 113

[56] References Cited

U.S. PATENT DOCUMENTS

| | | | |
|---|---|---|---|
| 438,179 | 10/1890 | Quarrie | 36/113 |
| 2,347,022 | 4/1944 | Austin | 101/128.1 |
| 2,784,736 | 3/1957 | Peterson | 36/113 |
| 3,362,775 | 1/1968 | Muecke | 401/6 |
| 3,526,917 | 9/1970 | Haywood, Jr. | 15/104.93 |
| 3,886,863 | 6/1975 | Carabott et al. | 101/128.1 |
| 4,856,599 | 8/1989 | Stammen | 36/113 |
| 5,174,203 | 12/1992 | Maeda | 101/129 |

FOREIGN PATENT DOCUMENTS

| | | | |
|---|---|---|---|
| 108670 | 1/1928 | Austria | 36/113 |
| 385738 | 5/1908 | France | 36/113 |
| 702538 | 4/1931 | France | 101/333 |
| 298879 | 10/1928 | United Kingdom | 36/113 |
| WO93026148A1 | 12/1993 | WIPO | 15/245 |

*Primary Examiner*—Eugene H. Eickholt
*Attorney, Agent, or Firm*—Cushman Darby & Cushman IP Group of Pillsbury Madison & Sutro, LLP

[57] ABSTRACT

A method and device for painting without the use of hands or arms is described in which a foot pad painting device has a generally planar paint pad secured to an attachment plate which in turn is connected to the painter's foot by an attachment mechanism. In use, the painter applies a stencil to a paint surface, attaches the foot pad painting device described and distributes paint on the paint surface by moving the foot paint pad across the stencil and the exposed paint surface.

5 Claims, 3 Drawing Sheets

STENCIL

METHOD AND DEVICE FOR PAINTING WITHOUT THE USE OF HANDS OR ARMS

BACKGROUND OF THE INVENTION

1. Field of the Invention

The present invention relates to a method and product for painting without the use of hands or arms.

2. Background Information

As a result of accident or disease, numerous individuals have lost the use of their hands or arms and have therefore also lost the ability to paint conventionally. Although it is possible to train the feet to take the place of the hand in painting, it is extremely difficult to grasp a paint brush with the feet, and extensive training is necessary before any meaningful use of the feet can be made in conventional painting.

SUMMARY OF THE INVENTION

According to the present invention, there is provided a device and method which will allow an individual, without the use of arms or hands, to paint using only his or her untrained foot and leg.

BRIEF DESCRIPTION OF THE DRAWINGS

The invention will now be described by way of example, with reference to the accompanying drawings in which.

DETAILED DESCRIPTION OF THE INVENTION

Figure 1:
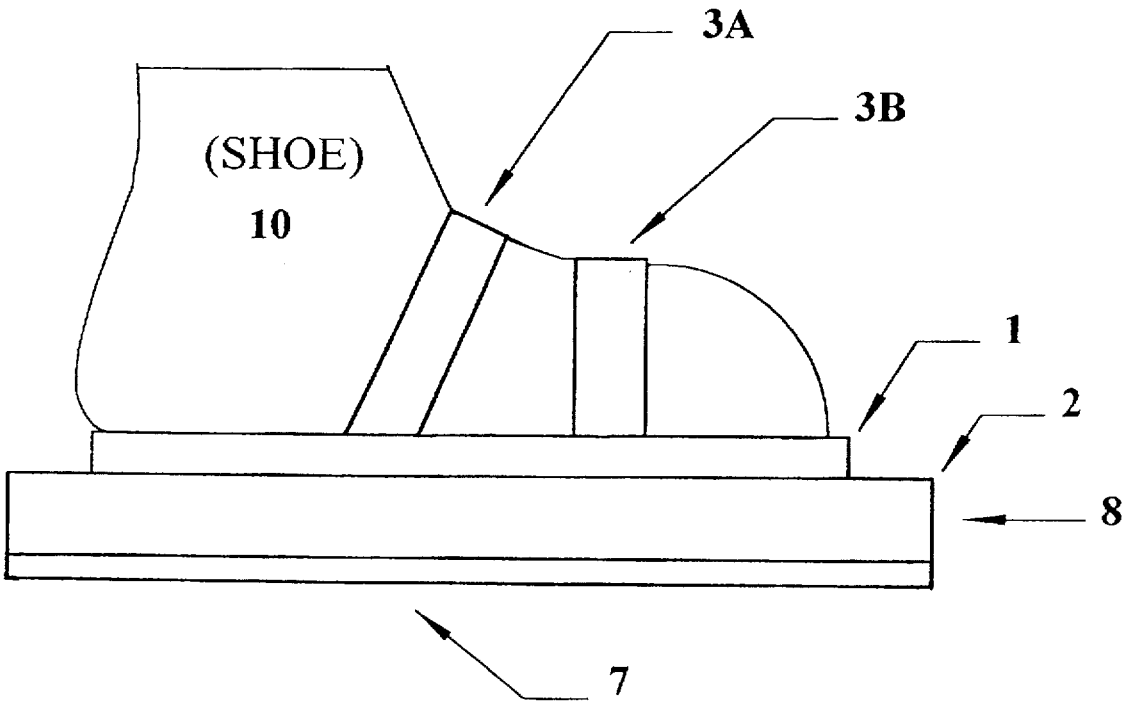
FIG. 1 shows a device according to the invention.

FIG. 1 depicts a preferred embodiment of the invention which includes a rectangular flat foam portion 8 and bristle pad portion 7 which together form the paint pad 2. The length and width of the paint pad 2 can be suitably adjusted to accommodate the shoe size of any individual painter. The bristle portion 7 of the paint pad 2 will touch the paint and the surface to be painted and the foam portion is secured directly to an attachment plate 1.

Figure 2:
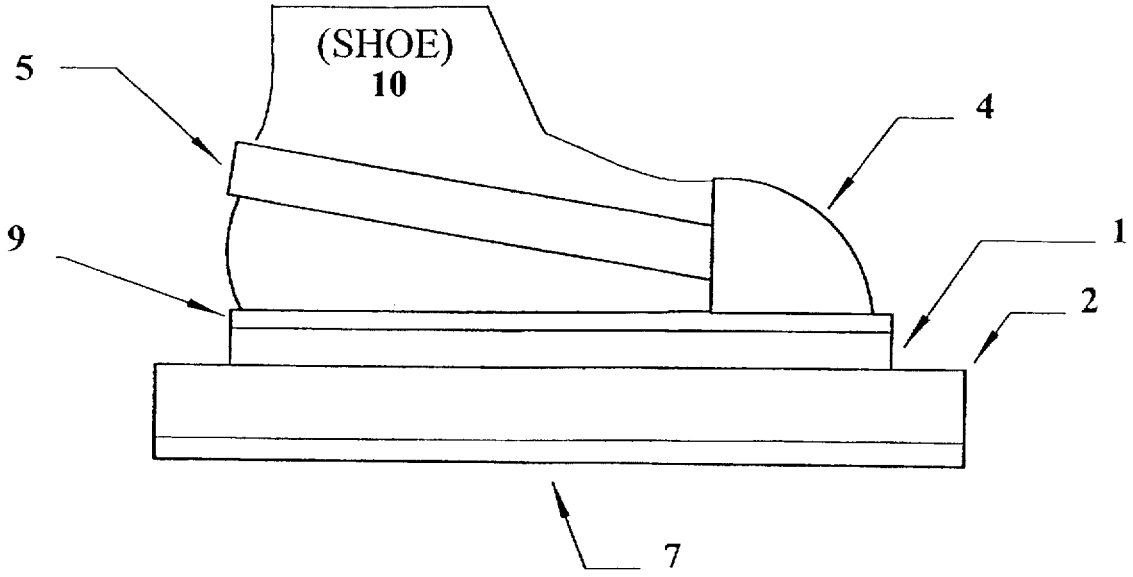
FIG. 2 shows an alternative form of the attachment mechanism used with the invention.

Another version of the paint pad 2 is illustrated in FIG. 2. The paint pad 2 of FIG. 2 is securely fastened under attachment plate 1. The attachment plate 1 of FIG. 2 is a flat, rectangular metal plate which has a ¼ inch raised lip 9 along the entire length of the two longer sides. The purpose of lip 9 along the sides of the rectangular metal plate of FIG. 2 is to secure the painter's foot (denoted as the "shoe (10)") so as to minimize lateral movement of the painter's foot. In this preferred embodiment of the device, the attachment plate 1 is centered on the paint pad 2, but the paint pad 2 extends beyond the attachment plate 1 on all four sides by ½ of an inch or more. For more detailed painting, the paint pad 2 portion of the device is reduced to allow for more precise application of paint.

Although many possible alternatives exist for attaching the foot paint brush to the painter's foot, only two attachment mechanisms are illustrated. In FIG. 1, the use of flexible straps over the foot is illustrated. Depending on the size of the foot of the individual painter, two (small shoes) or three (large shoes) adjustable flexible plastic strips 3A and 3B pass under and are attached to a bottom surface of the front half of the attachment plate 1. It should be understood that these flexible straps, 3A and 3B may be constructed of fabric, plastic, or rubber material and may employ a velcro fastener or buckle closure and fitting system.

When fastened, the flexible plastic straps 3A and 3B form large parallel loops above the paint pad 2 and attachment plate 1 where a foot or an athletic shoe 10 will be placed. The flexible plastic strips 3A and 3B secure the painter's foot to the attachment plate 1 and paint pad 2 in all directions. When unfastened, the flexible plastic straps 3A and 3B release the athletic shoe 10 from the device.

Alternatively, and as best illustrated in FIG. 2, the attachment mechanism of the present invention may utilize a toe cap 4 and a flexible strap 5 which forms a loop to encircle the painter's foot or shoe. The flexible strap 5 is anchored securely to the toe cap 4. As with the flexible straps described in connection with FIG. 1, the flexible strap 5 can be constructed of a fabric, plastic, or rubber material and may employ a velcro fastener or buckle closure and fitting system.

Figure 3:
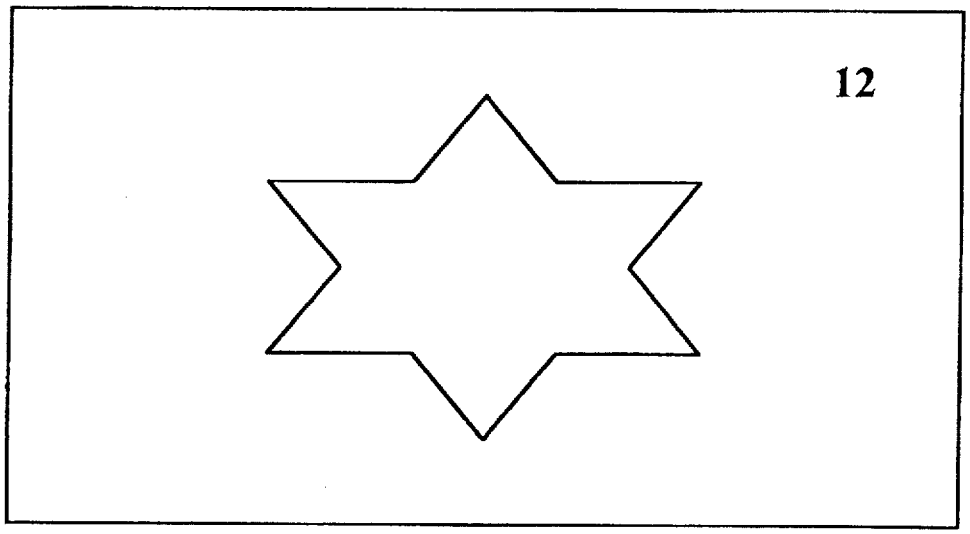
FIG. 3 shows a type of stencil which can be used in the present method of painting.

Because individuals' feet rarely have the same level of dexterity as hands, the above described painting device may be best employed in conjunction with stencils which are cut in any desired form or pattern. An illustrative example of a stencil is shown in FIG. 3, but it should be understood that a stencil 12 can be cut or shaped in any desired fashion.

In order to practice the present method, the stencil 12 is cut in the pattern or design to be painted. The stencil 12 is then placed on a surface which is to be painted. The individual painter then places his or her foot in a high top athletic shoe and then places his or her shoe or foot onto the rectangular attachment plate 1 and paint pad 2 and secures the shoe in place by fastening the flexible plastic straps 3A and 3B (or, alternatively, 5). Next, painting medium is placed on the paint pad 2 portion of the device.

The painter then places his or her foot onto the surface to be painted and moves his leg, ankle and foot around in order to distribute the paint on the surface being painted. Because the stencil 12 delineates the edges of the pattern or design being painted, the painter may paint to the edge and even onto the stencil 12 without painting outside the lines of the pattern or design.

While the stencils allow the individual painter to paint a precise design, the device may also be used without stencils to paint in a free-form fashion.

The device will allow those individuals who permanently or temporarily do not have the use of their arms and/or hands to paint.

What is claimed is:

1. A foot pad painting device comprising:

generally planar paint pad having an upper and a lower surface;

an attachment plate secured to said paint pad upper surface; and an attachment mechanism secured to the attachment plate for selectively securing and releasing the attachment plate to and from a painter's foot;

wherein the size and shape of the attachment plate is adapted to the painter's foot, and the paint pad lower surface is comprised of a foam portion which serves as a paint reservoir and a bristle portion which serves to apply paint.

2. A foot pad painting device according to claim 1, wherein the attachment mechanism comprises one or more straps which are formed into loops and have opposing ends which are secured to opposite sides of the attachment plate.

3. A foot pad painting device according to claim 1, wherein the attachment mechanism comprises a toe cap secured to the attachment plate formed into a loop having opposite ends which are secured to the toe cap.

4. A foot pad painting device according to claim 1, wherein the attachment mechanism includes a raised lip formed on opposite sides of the attachment plate, said raised lip run parallel to the painter's foot so as to provide lateral stability and control over the paint pad.

5. A method of painting using a painter's foot comprising the steps of:

creating an exposed paint surface by applying a stencil to a surface to be painted;

attaching a foot pad painting device having a generally planar paint pad, an attachment plate adapted in size and shape to the painter's foot, and an attachment mechanism;

applying paint to the paint pad; and painting exposed paint surface by moving the foot paint pad so as to brush the paint pad across said stencil and exposed paint surface so as to obtain desired pattern.

* * * * *